US008839736B2

(12) United States Patent
Bort

(10) Patent No.: US 8,839,736 B2
(45) Date of Patent: Sep. 23, 2014

(54) BOX FLAG

(76) Inventor: Bruce Frank Bort, Lemont, IL (US)

( * ) Notice: Subject to any disclaimer, the term of this patent is extended or adjusted under 35 U.S.C. 154(b) by 364 days.

(21) Appl. No.: 13/189,662

(22) Filed: Jul. 25, 2011

(65) Prior Publication Data

US 2012/0017822 A1 Jan. 26, 2012

Related U.S. Application Data

(60) Provisional application No. 61/400,220, filed on Jul. 26, 2010.

(51) Int. Cl.
*G09F 17/00* (2006.01)
*G09F 13/16* (2006.01)
*G09F 13/04* (2006.01)

(52) U.S. Cl.
CPC ..... *G09F 17/00* (2013.01); *G09F 2013/0431* (2013.01); *G09F 13/16* (2013.01); *G09F 2013/0468* (2013.01); *G09F 2013/049* (2013.01)
USPC ..... 116/173

(58) Field of Classification Search
USPC ..... 116/173, 174, 175; 40/218, 439, 441, 40/443, 541, 546, 563, 607.03; 362/431
See application file for complete search history.

(56) References Cited

U.S. PATENT DOCUMENTS

| | | | | | |
|---|---|---|---|---|---|
| 1,171,917 | A * | 2/1916 | Axford | 116/173 |
| 1,256,232 | A * | 2/1918 | Howard | 116/173 |
| 1,740,747 | A * | 12/1929 | Price | 40/441 |
| 1,820,157 | A * | 8/1931 | Vaclav | 40/541 |
| 1,878,447 | A * | 9/1932 | Sutphen | 116/173 |
| 2,280,817 | A * | 4/1942 | Freeman | 40/545 |
| 3,305,961 | A * | 2/1967 | Lanzon et al. | 362/486 |
| 4,627,278 | A * | 12/1986 | Soto | 73/170.06 |
| 5,103,582 | A * | 4/1992 | Farmer | 40/607.12 |
| 5,477,437 | A * | 12/1995 | Lach | 362/249.16 |
| D376,122 | S * | 12/1996 | Stine et al. | D11/165 |
| 6,148,551 | A * | 11/2000 | Glass | 40/214 |
| 6,622,649 | B1 * | 9/2003 | Shaw | 116/173 |
| 6,698,122 | B1 * | 3/2004 | Merenlender | 40/572 |
| 6,783,259 | B1 * | 8/2004 | Macedonio | 362/249.12 |
| 7,788,832 | B2 * | 9/2010 | Yebenes De Madrid | 40/218 |
| 8,215,807 | B1 * | 7/2012 | Brunesti | 362/431 |
| 2006/0023446 | A1 * | 2/2006 | Racoosin | 362/227 |
| 2006/0130380 | A1 * | 6/2006 | Aires | 40/603 |
| 2006/0171147 | A1 * | 8/2006 | Day | 362/249 |
| 2006/0207143 | A1 * | 9/2006 | Brown | 40/610 |
| 2007/0199217 | A1 * | 8/2007 | Jong | 40/542 |
| 2012/0281391 | A1 * | 11/2012 | Bort | 362/183 |
| 2013/0250559 | A1 * | 9/2013 | Hawkins | 362/183 |

FOREIGN PATENT DOCUMENTS

| | | | | |
|---|---|---|---|---|
| EP | 1291834 | A1 * | 3/2003 | G09F 15/00 |
| GB | 2498991 | A * | 8/2013 | G09F 17/00 |
| GB | 2499126 | A * | 8/2013 | G09F 17/00 |
| JP | 2000010515 | A * | 1/2000 | G09F 17/00 |
| WO | WO 2008101721 | A1 * | 8/2008 | F21L 4/00 |
| WO | WO 2009008705 | A1 * | 1/2009 | G09F 17/00 |

* cited by examiner

*Primary Examiner* — R. A. Smith

(57) ABSTRACT

A flag made with a space inside for illuminating with light from an illuminated flagpole and made to capture the light to prevent light pollution, thus creating a highly visible night-time flag.

3 Claims, 8 Drawing Sheets

BOX FLAG

This application claims priority from previously filed Provisional Application filed on Jul. 26, 2010 and assigned Ser. No. 61/400,220. This invention relates to a flag that is illuminated at night or in a dark area. It is made mainly for a wall-mount or swooper/banner illuminated flagpole, but could have other uses.

BACKGROUND OF INVENTION

Homeowners, business owners, and others who wish to have their flags be illuminated at night (as the guidelines for showing respect for the United States flag suggest). Also for holiday flags, sports team flags, and other advertising. The Box Flag is made to be illuminated by putting it on an illuminated flagpole.

BRIEF DESCRIPTION OF INVENTION

Two flags sewn together by a strip of material which forms the sides and bottom edge of the Box Flag. The strip which forms the edge can be made of reflective material on the inner side in order to increase the illumination inside the Box Flag. The outer side of the strip can be made of material such as thick nylon, polyester, cotton or other suitable material (whether translucent or not). The strip which forms the edge around 3 sides (bottom and sides) of the Box Flag would be approximately 1¼ inch or 1⅜ inch in width to allow for the border of the two flags to be sewn together. The strip would be as long as the bottom and both sides of the flag (less 2½ inches so when it is sewn together, there is a 1¼ inch opening at each top corner of the Box Flag so that it can be slid over the flagpole. The top of the Box Flag is formed by sewing the two top borders of the flag together. If the flags do not have a border, one would need to be added before the flags are sewn together in order to protect the integrity of the flag. When the illuminated flag pole is lit, the Box Flag is illuminated from the inside and there is no unused light pollution. By capturing all the light from the flagpole, it makes the flag more appealing to the viewer's eye. When using a Box Flag with a Solar-Powered Swooper/Banner Flagpole, the use of snaps are used to secure the Swooper/Banner Box Flag to the pole.

DETAILED DESCRIPTION OF DRAWINGS

Figure 1:
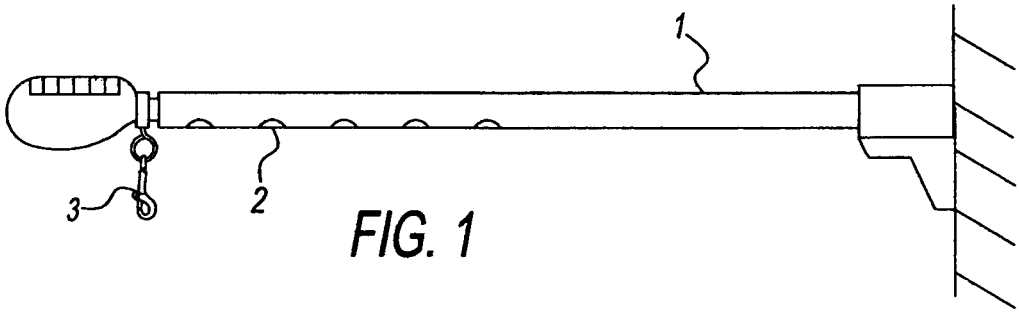
FIG. 1: Solar-powered illuminated wall-mounted flagpole
Figure 2:
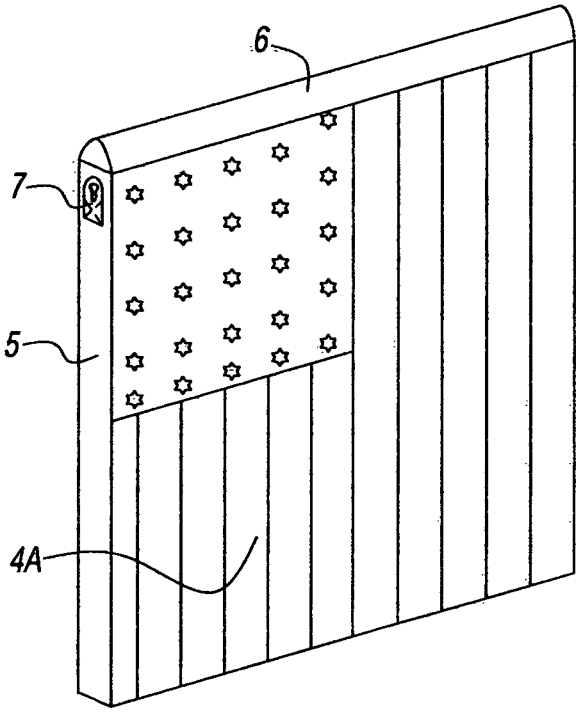
FIG. 2: Box Flag—front view

In FIG. 1, #1 shows an illuminated flagpole; #2 shows holes where light shines out of the flagpole; #3 is the hook to attach to upper corner of Box Flag In FIG. 2, #4A shows face of Box Flag which is the same on each side; #5 is the strip of material which goes down both sides and across the bottom to form the edge which joins the two flags together; #6 shows the top border of the flag (two flags sewn together); #7 is the piece of material sewn to the upper corner of the Box Flag that attaches to the flagpole hook.

Figure 3:
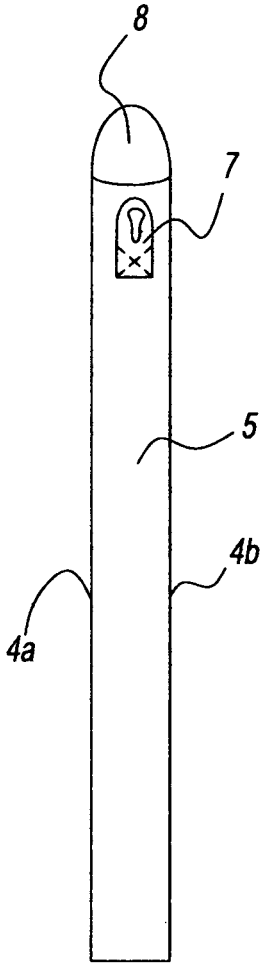
FIG. 3: Box Flag—side view

In FIG. 3, #8 shows the hole which slips over the flagpole, and #4A and #4B sewn and attached to #5.

Figure 4:
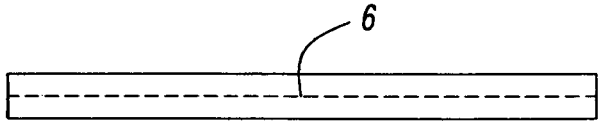
FIG. 4: Box Flag—top view

In FIG. 4, #6 is the top view of the Box Flag consisting of the two top edges/borders of the flag sewn together.

Figure 5:
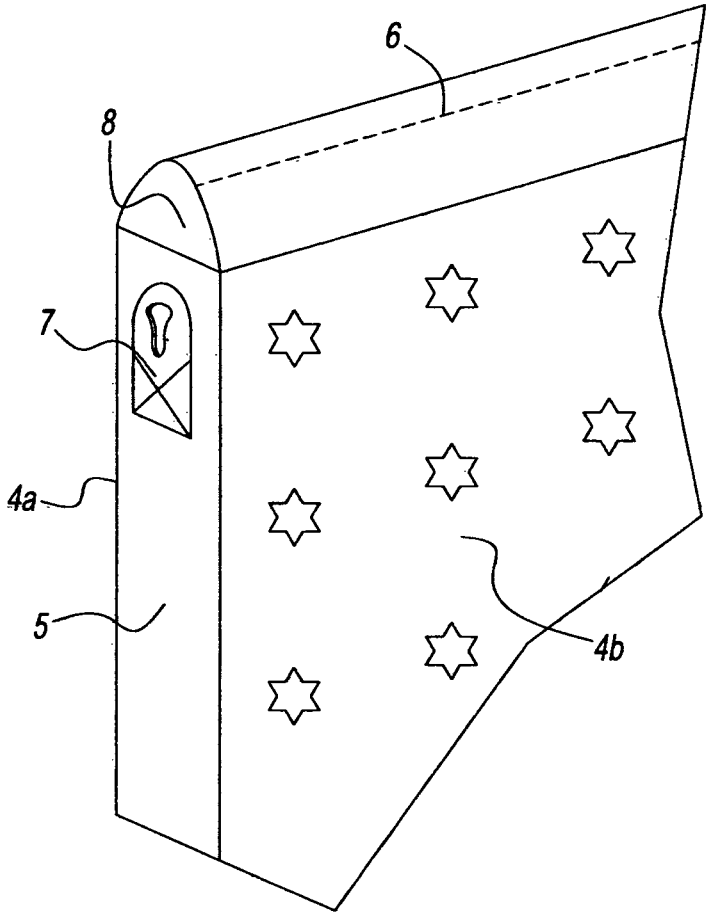
FIG. 5: Close-up view of the upper corner of Box Flag where it attaches to the hook on a flagpole.

In FIG. 5, #5 shows how the material stops to allow for the #8 holes to receive the flagpole on each end; #7 is the piece of material which gets attached to the flagpole hook.

Figure 6:
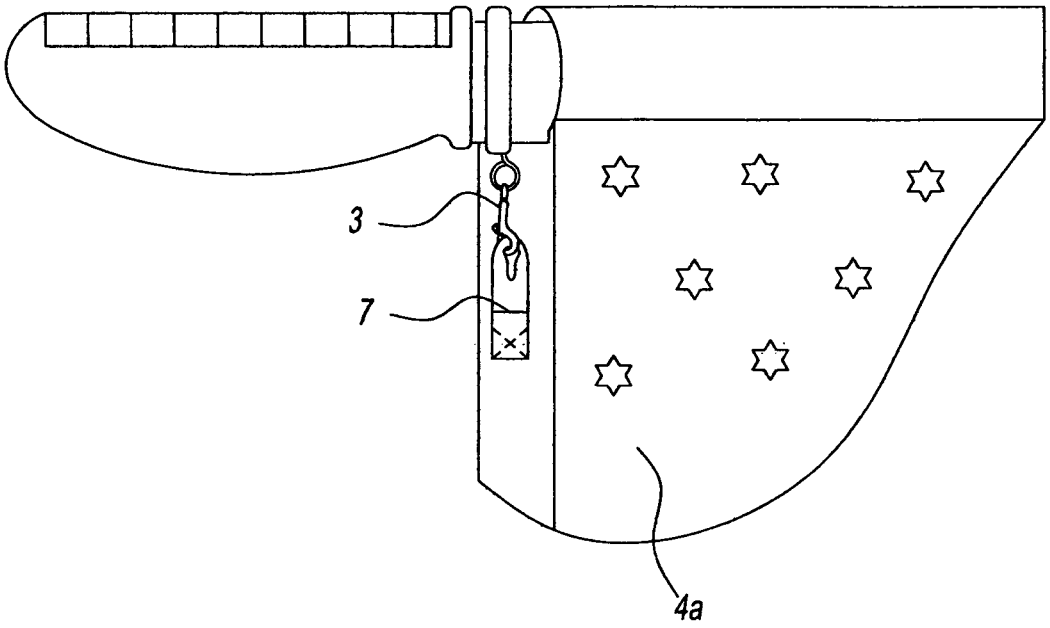
FIG. 6: Close-up of Box Flag hooked to the solar flagpole

In FIG. 6, #7 is hooked to #3 to keep the Box Flag from sliding down/off the flagpole.

Figure 7:
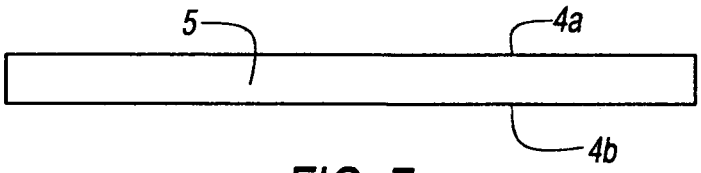
FIG. 7: Strip of material which forms the bottom and side edges of the Box Flag

In FIG. 7, #5 shows the material that is on the exterior of the edge along the bottom and sides of the Box Flag. Can be made of translucent material to complement the design of a particular flag—or it can be made of non-translucent material with a reflective material on the interior to help reflect the light inside the Box Flag.

Figure 8:
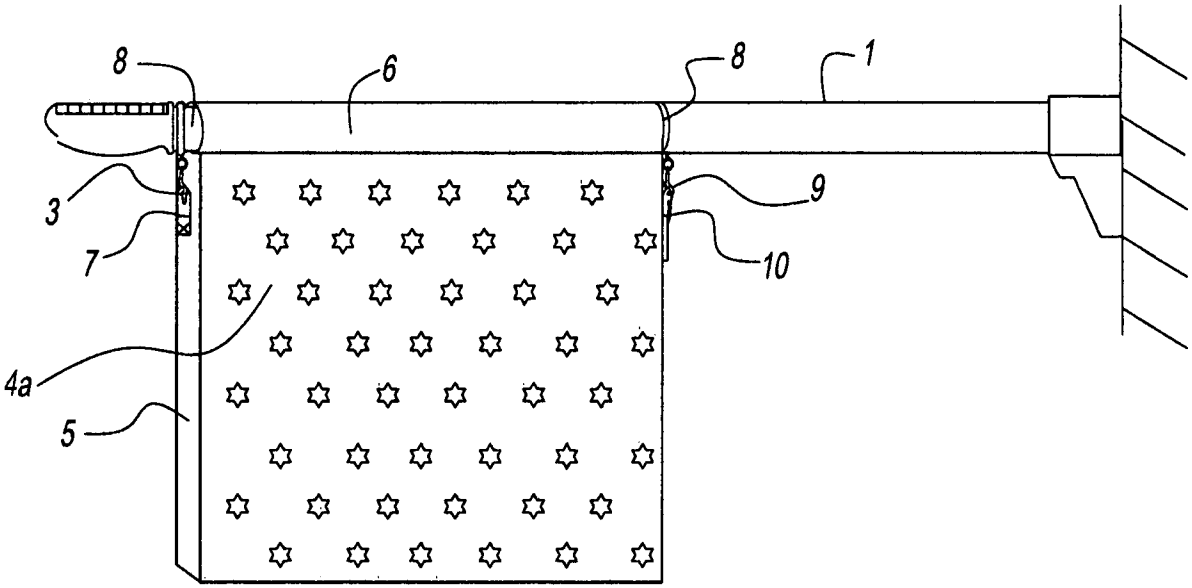
FIG. 8: Box Flag on a solar flagpole

In FIG. 8, the Box Flag is slid over #1 through #8 holes at each end of the top of the Box Flag and by hooking #3 to the hole in #7—and #9 to the hole in #10 (#9 and #10 are the same as #3 and #7, but are on the opposite side of the Box Flag. #4A is the front face of the Box Flag which would be made of translucent material to illuminate the flag when lit.

Figure 9:
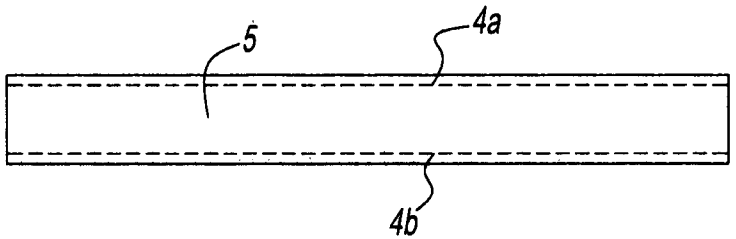
FIG. 9: Box Flag—bottom view

In FIG. 9, #5 shows the bottom edge of the Box Flag sewn to #4A and #4B (the two faces of the Box Flag).

Figure 10:
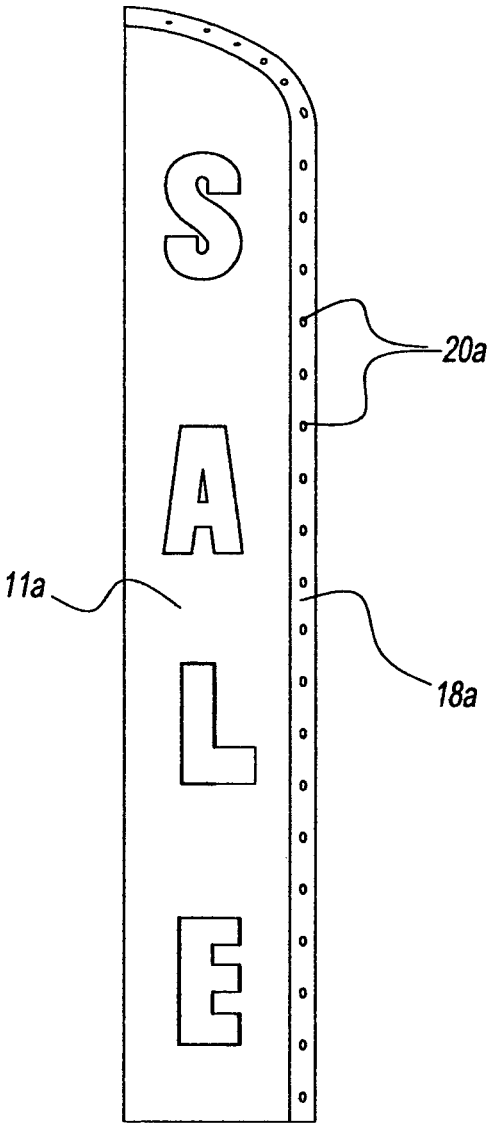
FIG. 10: Swooper/Banner Box Flag

In FIG. 10, #11A shows the front face of a Swooper/Banner Box Flag. #20A shows female snaps that run from the top to the bottom of the flag and go though #18A. #18A is the edge or border of the flag made of a durable material such as canvas, strong nylon, polyester or other suitable material.

Figure 11:
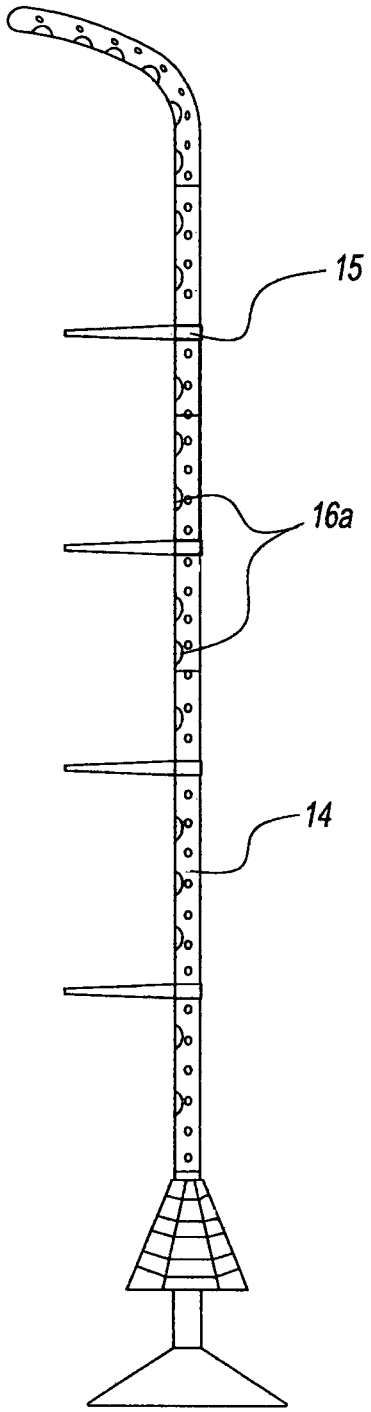
FIG. 11: Solar-powered illuminating swooper flagpole
Figure 12:
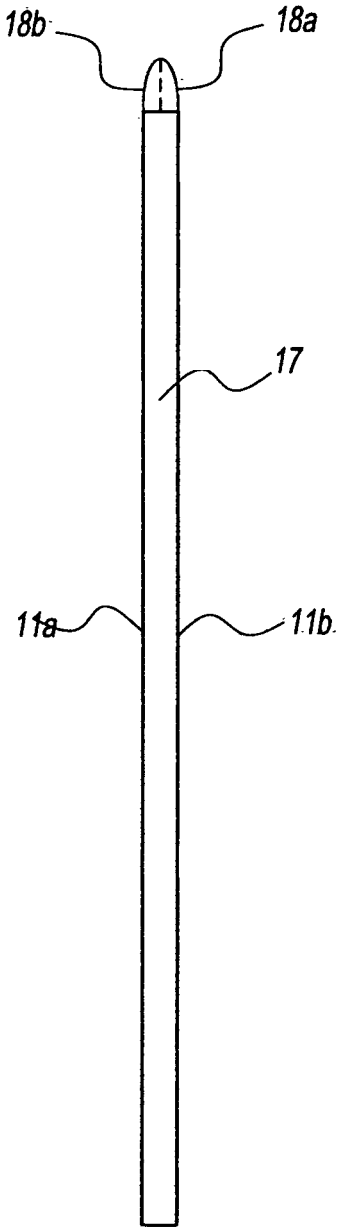
FIG. 12: Side view of Swooper/Banner Box Flag

In FIG. 11, #14 shows a Solar-Powered Swooper/Banner Flagpole. #15 shows a thin plastic spacer made to keep the inside of the flag open for light illumination. #16 shows male snaps for receiving female snaps on the Swooper/Banner Box Flag to secure it to the flagpoles FIG. 12 is a side view of a Swooper/Banner Box Flag. #17 is a strip of material that is used to sew #11A and #11B (the two faces of the flag) together. #17 is also sewn at the top to #18A and #18B. It can be made to be translucent and complement the flag or can be non-translucent with the inside being made of reflective material like mylar or similar material to help illuminate the flag.

Figure 13:
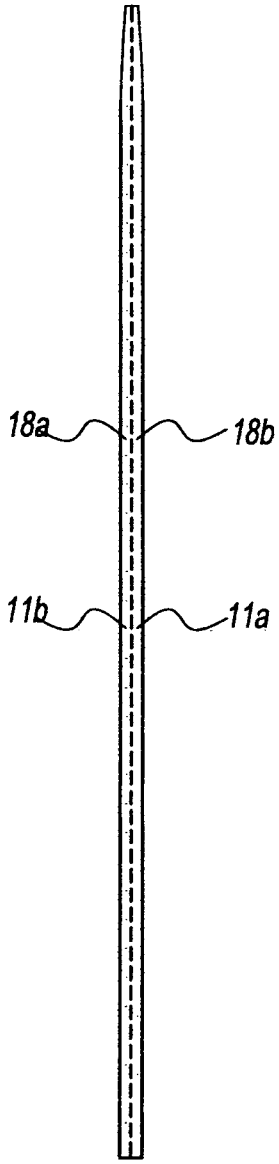
FIG. 13: Back view of Swooper/Banner Box Flag

FIG. 13 is a back view of the Swooper/Banner Box Flag. #18A and #18B shows the back of the two edges/borders of #11A and #11B that are sewn together.

Figure 14:
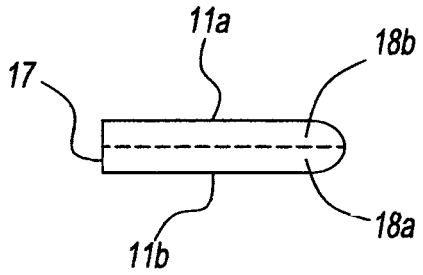
FIG. 14: Top view of Swooper/Banner Box Flag

FIG. 14 shows a top view of a Swooper/Banner Box Flag. #18A and #18B shows the top two edges/borders sewn together.

Figure 15:
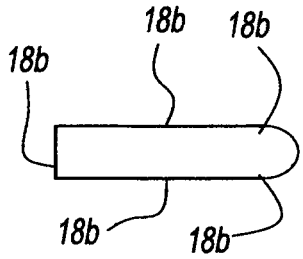
FIG. 15: Bottom view of Swooper/Banner Box Flag

FIG. 15 shows a bottom view of a Swooper/Banner Box Flag with all sides sewn together (#17 to #11A and #11B). #18A and #18B are also sewn together. The bottom is open.

Figure 16:
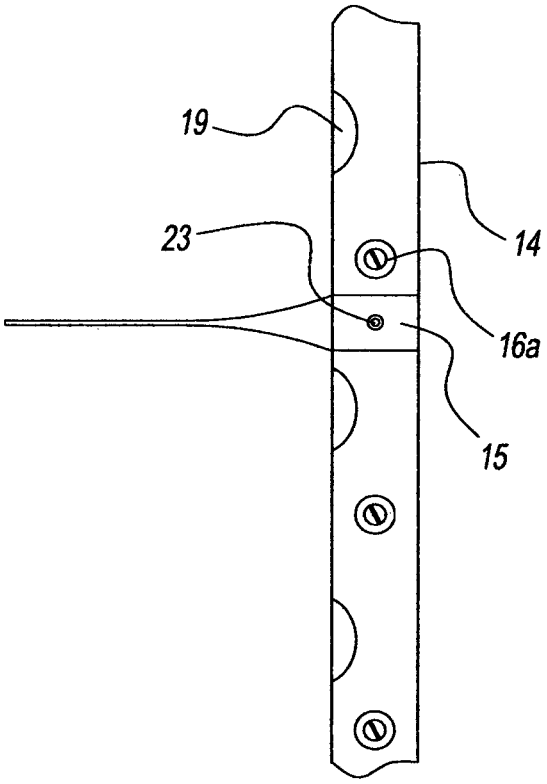
FIG. 16: Side view of Swooper/Banner Flagpole

FIG. 16 is a side view of a Solar-Powered Swooper/Banner Flagpole. #16A is a male snap that is attached to the flagpole and made to receive the female snap #20A on the Swooper/Banner Box Flag. #19 shows the lens over an LED light. #15 is the plastic spacer, #23 is the plastic/screw/fastener that holds #15 in place.

Figure 17:
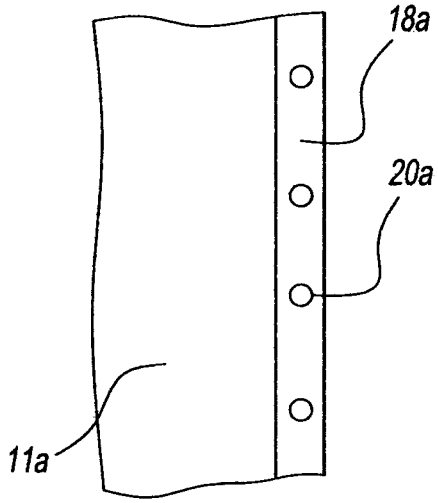
FIG. 17: Front view of Swooper/Banner Box Flag

FIG. 17 is a front view of a section of a Swooper/Banner Box Flag. #20A shows the female snaps on the flag for attaching to #16A the male snaps on the flagpole.

Figure 18:
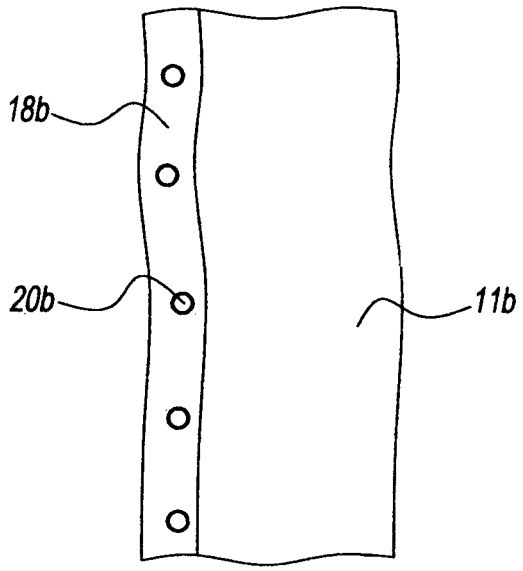
FIG. 18: Back view of Swooper/Banner Box Flag

FIG. 18 is a back view of a section of a Swooper/Banner Box Flag. #20B shows the female snaps on the flag for attaching to #16B the male snaps on the flagpole.

Figure 19:
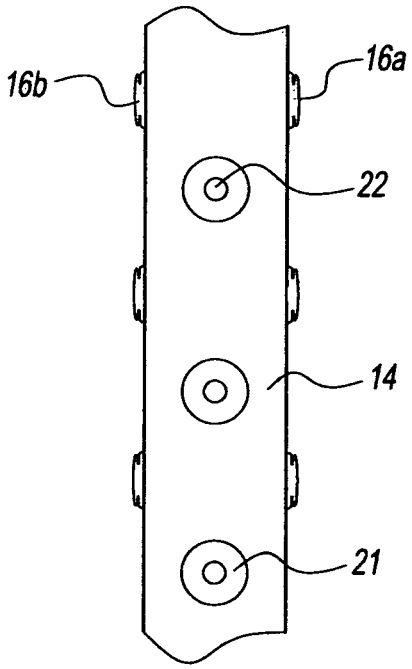
FIG. 19: Front view of Solar-Powered Swooper/Banner Flagpole

FIG. 19 shows the front view of a section of a Solar-Powered Swooper/Banner Flagpole. #16A and #16B are male snaps for receiving the female snaps #20A and #20B of the flag to secure it to the flagpole. #21 shows the reflector inside the flagpole. #22 shows the LED light(s) inside the flagpole.

Figure 20:
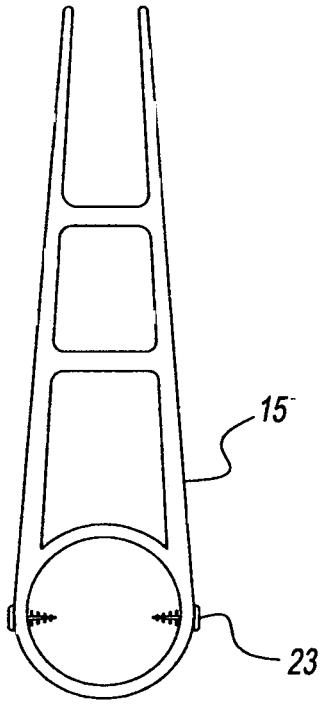
FIG. 20: Plastic spacer to keep flag open

FIG. 20 shows the plastic spacer for keeping the space open inside the Swooper/Banner Box Flag. #23 shows the fasteners for securing #15 to the flagpole.

While the present invention has been described with respect to different embodiments, it will be appreciated that many modifications and variations may be made without departing from the spirit and scope of the invention. It is therefore the intent of the appended claims to cover all such modifications and variations which fall within the spirit and scope of the invention.

What is claimed:

1. A box flag comprising:

a swooper banner flagpole, said flagpole having a plurality of lights, a swooper banner flag, said flag having two translucent faces which are sewn together along the edges with the exception of the bottom side, said bottom side being open and said flag having an inside space, said bottom side and said inside space being configured for acceptance of said flagpole therein, the plurality of lights illuminated the inside space and the two translucent faces, at least one plastic translucent spacer for keeping the inside space open, the spacer having a hole and fasteners for securely positioning the spacer upon said flagpole, the spacer further having two arms spaced apart which are interconnected by cross members for keeping the inside space of the flag open for light illumination.

2. A box flag according to claim 1 wherein said at least one plastic translucent spacer comprises a plurality of the plastic translucent spacers.

3. A box flag comprising:

a swooper banner flagpole, said flagpole having a plurality of lights, a swooper banner flag, said flag having two translucent faces which are sewn together along the edges with the exception of the bottom side, said bottom side being open and said flag having an inside space, said bottom side and said inside space being configured for acceptance of said flagpole therein, the plurality of lights illuminated the inside space and the two translucent faces, at least one spacer attachable to the flagpole at a position so that the spacer is located within the inside space of the flag, the flagpole further having a plurality of snaps running from a top to a bottom of the flagpole, and the flag further having a plurality of corresponding snaps positioned along the flag for attachment to the snaps on the flagpole, said snaps allowing the flag to move naturally and the faces to be illuminated without obstruction.

* * * * *